United States Patent [19]

Kelley et al.

[11] 4,141,464

[45] Feb. 27, 1979

[54] CLOSURE AND METHOD FOR EASY OPENING OF CANS

[75] Inventors: John S. Kelley, Wenham; Albert E. Newton, Beverly, both of Mass.

[73] Assignee: USM Corporation, Farmington, Conn.

[21] Appl. No.: 908,734

[22] Filed: May 23, 1978

[51] Int. Cl.[2] ..... B65D 41/32

[52] U.S. Cl. ..... 220/267; 220/270; 220/277

[58] Field of Search ..... 220/267-273, 220/277

[56] References Cited

U.S. PATENT DOCUMENTS

| | | | |
|---|---|---|---|
| 3,853,242 | 12/1974 | Zundel | 220/267 |
| 3,981,411 | 9/1976 | Hofstetter | 220/267 |
| 4,062,471 | 12/1977 | Perry | 220/269 |

*Primary Examiner*—George T. Hall

*Attorney, Agent, or Firm*—Carl E. Johnson; Richard B. Megley; Vincent A. White

[57] ABSTRACT

A can having a closure defined at least in part by a rupturable weakening line is provided with a finger-movable tab-like tool for safely opening the closure. The tool is a sheet metal lever pivotally attached to a can end in which the closure is deflectible and preferably non-severable. A depressor portion of the lever is raised from its prone or inoperative position and, in part, twisted about 90° to locate its pressure-directing beak adjacent to a point along the weakening line, whereupon downward finger pressure on the depressor portion disrupts the line and deflects the closure inwardly. The lever is so shaped that depression of the twistable portion is limited by engagement therewith of an edge of the opening thus barring finger entry into the can opening as a safety measure. The lever may be provided at its opposite end with a handle whereby, when the closure has been opened as explained, the lever may be swung to clear the depressed end portion substantially from the can opening.

13 Claims, 4 Drawing Figures

CLOSURE AND METHOD FOR EASY OPENING OF CANS

CROSS-REFERENCE TO RELATED APPLICATION

An application for U.S. patent Ser. No. 908,733, filed May 23, 1978 in the names of John S. Kelley et al relates to a method of making easy-open can ends.

BACKGROUND OF THE INVENTION

Easy-open can closures have been proposed in a great many different designs and constructions. In general those types which permit a closure or pull tab to be separable from a can have encountered public disfavor because of potential litter. Some can closures have been depressible into their containers and remain attached thereto; of these, various opening tabs of the pull or depressor types have been provided. The consequent arrangements have been complex and costly.

In U.S. Pat. Nos. 3,881,437 and 3,881,630, both issued in the names of Lovell and Grise, a relatively simple and economical digitally operable can end and method of making it are disclosed. Opening a can end closure according to these patents requires mere finger depression to rupture a unique weakening line. It has been found, however, that often consumers, having become accustomed to the usage of pull tabs and the like for opening purposes, are reluctant to simply apply finger pressure directly to a closure to depress it relative to a can end, apparently feeling that they might scratch a finger on a sharp edge even when no sharp edge is present. It therefore is desirable to provide, in combination with a depressible easy-open can end closure, a simple and easy-to-operate and saft-to-use opening means. Such means is proposed herein though it will be recognized as not necessarily limited to use with the Lovell-Grise closure.

SUMMARY OF THE INVENTION

It accordingly is a main object of this invention to provide an easy-open can end of the type having a closure at least partly defined by a weakening line with a simple, yet effective and safe-to-use means for manually operating the closure.

More specifically it is an object of this invention to provide a can end with a novel finger-bendable depressor for rupturing a closure portion of the end without finger contact with the closure.

To these ends, and as herein shown, there is mounted on a can end having a closure defined at least partly by a weakening line, a lever having a handle portion and a twistable depressor portion. The latter, sometimes referred to as a "gooseneck" is disposed adjacent to the weakening line when inoperative but may be lifted from the can end in a substantially 90° twist about an axis generally parallel to the can end and closure thus to position an extremity or "beak" at a point of the line to be ruptured. An arcuate flange of the depressor portion is then arranged to be engaged digitally, for instance, by a thumb, and pressed toward the interior of the can. The beak consequently disrupts the weakening line at an initial point and progressively to both sides thereof as the closure is deflected into the can. The flange is stopped from entering the can by reason of an edge of the closure abutting the depressor portion. Accordingly the thumb or other digit is barred from entry and contact with sharp or rough edges. Now the handle portion may, on being urged about a pivot of the lever, swing the depressor laterally to clear the can end opening. This latter maneuver is usually optional since ordinarily the width of the depressor portion of the handle and its thickness will not afford resistance or blockage to flow of the can contents.

It is not essential to pivotally mount the lever on the can end, but when it is so secured, a small ridge or stop formation in the can end may limit rotation of the lever in one direction. A detent in the handle portion releasably mating with a corresponding protrusion in the can end may serve to initially position the lever angularly.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF THE PREFERRED EMBODIMENT

Figure 1:
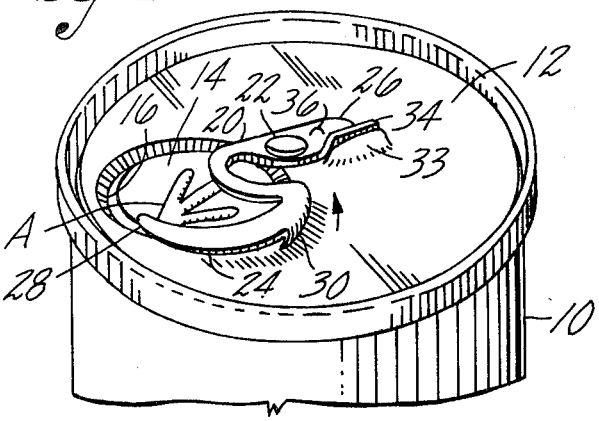
FIG. 1 is a perspective view of a typical can end having a closure defined by a weakening line, and a finger-operating means in inoperative position for opening the closure.

Referring first to FIG. 1, a typical sheet metal can 10 is provided with a can end 12 which is generally planar and includes therein a closure generally designated 14. Although the latter is herein shown by way of example as being of the type disclosed in the mentioned Lovell and Grise patents and hence at least partly defined by a weakening line 16 which comprises a fractured but integral section, it is to be noted that the present invention is not limited to usage with closures of any particular type but has application to any closure defined at least in part by a disruptible weakening line however made. It will also be understood that the closure 14 is herein shown as circular for the sake of simplicity, but it need not be of any particular configuration.

As indicated by the point of an arrow A, the closure 14 may have a selected locality along its weakening line 16 whereat it is desirable to commence disruption of the sheet metal for opening the can. In many instances, including the illustrative arrangement, the selected locality is close to the rim of the can end where the sheet metal is apt to be more rigid. Substantially diametrically opposite from this locality and adjacent to the closure 14, a closure opening tab or lever 20 preferably of deformable sheet metal, for instance steel, is pivoted to the can end 12 as by a fastener such as a rivet 22. The rivet or other suitable pivotal connection enables the lever to be turned about an axis normal to the end 12 for a purpose subsequently explained. The lever comprises a depressor portion 24 to one side of the rivet, and a handle portion 26 extending on the opposite side thereof.

Figure 2:
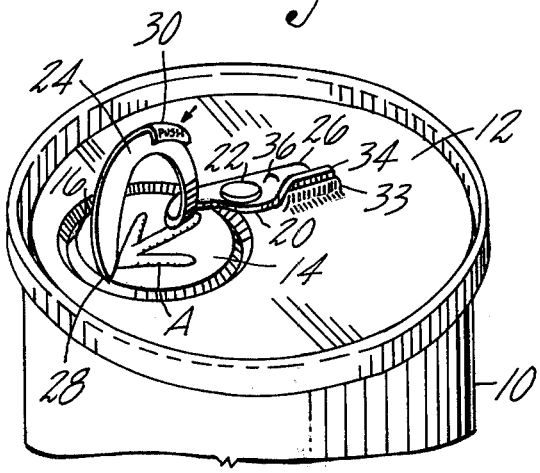
FIG. 2 is a view similar to FIG. 1, the opening means being shown as a lever and at its next stage wherein a depressor portion of the lever has been lifted and in part twisted to position if for disruption of the closure.

As shown in FIG. 1 the depressor portion 24 in its flat inoperative condition, is generally S-shaped, extends adjacent to the closure 14, and terminates in a pressure point or beak 28. It will be appreciated that the lever 20 may have other configurations for other shapes of closures to be opened thereby. A rounded flange 30 projects downwardly (as shown in FIG. 1) from a convex midsection of the depressor portion and may engage the can end to bias the beak 28 toward the point of the arrow A. As a first step in opening the closure 14, fingers may pry or seize the depressor portion 24 at the flange 30 to lift it above the can end as shown in FIG. 2. The portion 25 is accordingly twisted about 90° about an axis approximately parallel to the can end in order to position the beak 28 substantially in engagement endwise with the weakening line 16 at the tip of the arrow A.

Figure 3:
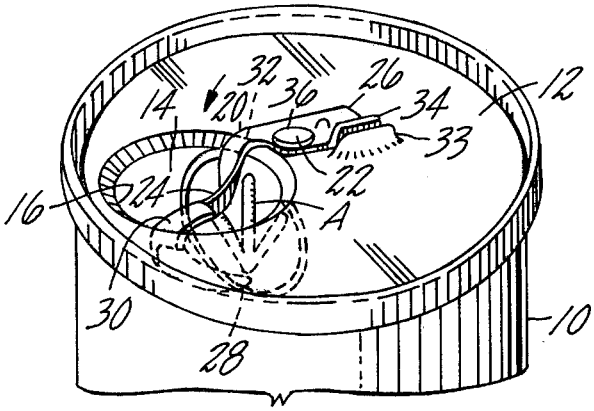
FIG. 3 is a view similar to FIGS. 1 and 2 but showing the opening lever at a subsequent stage wherein the closure has been deflected inwardly.

The shape and movement of the usually slender depressor portion 24 is somewhat suggestive of that of the neck of a goose. Little resistance is met in bending the portion 24 to its raised position, yet when next finger pressure is brought to bear downwardly on the flange 30 to assert force edgewise via the portion 24, the beak 28 is effective to transmit disruptive pressure on the weakening line 16 at the point of the arrow A. Continued depression of the flange 30 causes the beak to deflect the closure 14 inwardly as the line 16 is progressively broken along opposite sides from the initial rupture point. It is to be observed, though, that as indicated in FIG. 3, the flange 30 is barred from entering the can opening since an edge of the opening serves as a stop upon engaging a locality 32 on the underside of the lever 20 adjacent to the rivet 22. Accordingly, the finger which had been pushing on the flange 30 is barred from contact with an edge of the can opening.

Figure 4:
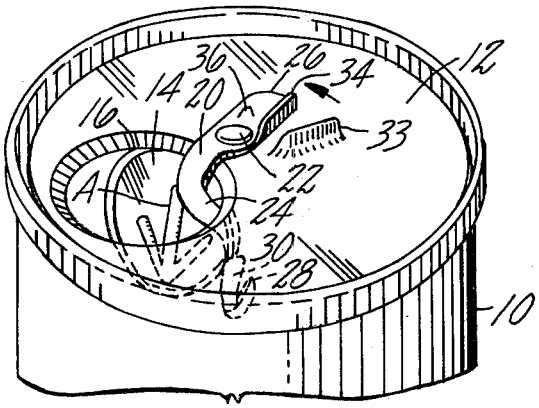
FIG. 4 is a view largely corresponding to FIGS. 1–3 but showing the lever lastly shifted angularly to more fully clear the can opening.

The can top opened as shown in FIG. 3 is often acceptable for pouring out of contents without any further step. If it is desired to further clear the bent depressor portion 24 from the can opening, the handle portion 26 may be swung about the rivet axis as indicated in FIG. 4. This causes the beak 28 to move laterally to one side of the closure opening where very little if any interference is offered to pouring of the can contents.

In order to facilitate the proper angular positioning of the lever 20 on the can end 12, it may be desirable to provide a small ridge 33 in the can end to serve as a stop for a flange 34 formed on the handle portion 26. A detent 36 in the portion 26 may releasably engage a correspondingly shaped protrusion in the can end to fix the initial lever position against the ridge (not shown) as indicated in FIG. 3.

Operation of the closure opening device described will be apparent from the foregoing. In addition to being easy to use effectively, the device features both safety and low cost. Basically the user does a 1–2 step procedure: he lifts the depressor portion of the lever 20 from its flat or prone position to a raised position over the closure as shown in FIG. 2, and then pushes the depressor portion in a rocking motion downwardly. In this opening process he is first partly twisting the rather slender sheet metal neck adjacent to the rivet 20 to transfer the depressor portion from a flexible parallel relation to the can end to a stiffened normal relation thereto. Downward thrust on the flange 30 to rock the beak inwardly of the can will not buckle the depressor portion prior to the beak 28 effecting rupture along the weakening line.

It is apparent from the foregoing that the invention further provides a stackable can end which is also easily openable without endangering a finger or thumb. Moreover, since the depressor portion will be pushed into the can, no portion of the can end or its tab is likely to be broken off to be scattered.

What is claimed is:

1. A can having an easy-open closure at least partly defined by a weakening line, and finger operable means comprising a lever secured to the can adjacent to the closure, the lever including a bendable sheet metal depressor portion movable by twisting from an inoperative position adjacent to the can to a position wherein a reduced width or pointed end of the depressor portion can be thrust against a point along said line to deflect and open the closure inwardly of the can.

2. A can as in claim 1 wherein the closure is formed in an end thereof, and the lever is initially generally S-shaped.

3. A can as in claim 1 or 2 wherein the point of said line to be initially disrupted is disposed adjacent to a rim of an end of the can, the lever is secured to said end of the can at a locality across the closure from said point, and said depressor portion is twistable up to about 90° about an axis generally parallel to the can end.

4. A can as in claim 1 wherein said lever is pivotally secured to the can and comprises a handle portion for moving said depressor portion after the latter has been rocked to open the closure thus to largely clear the opening.

5. A can as in claim 2 wherein the depressor portion is formed with a flange spaced from its pointed end to accommodate finger pressure for causing said pointed end to disrupt said line.

6. A can as in claim 3 wherein the arrangement is such that the depressor portion, when twisted and bent to inwardly deflect the closure by finger-applied pressure, is barred by engagement with the can from entering the can opening to an extent wherein a finger can contact an edge of the opening.

7. A can as in claim 4 wherein the handle portion is formed with an upturned flange and a releasable detent, a protrusion formed in the can for cooperating with the detent, and a stop formed in the can and arranged to engage the handle flange to determine the initial position of the lever in cooperation with said detent and protrusion.

8. The combination with an easy-open can end of the type having a closure defined at least in part by a disruptible weakening line, of a closure operating lever pivotally secured to the can end, the lever being of generally thin and flat cross-section of facilitate bending and having a longitudinal curvature terminating in a beak for applying disrupting pressure to a point along said line when force is manually applied edgewise to a convex portion of said curvature.

9. A method for opening a can end having an easy opening closure defined by a weakening line, the method comprising providing an elongated, twistable lever of sheet metal, and securing the lever to the can end at one locality outside of the closure so that a free end of the lever initially in juxtaposition to the can end, can be brought manually to bear with pressure at a point along said line to progressively deflect the closure into the can.

10. The method of claim 9 further characterized in that the shapes of the lever and the closure are selected to prevent depression of the lever into the opened can to an extent wherein a finger manipulating the lever could contact an edge of the can opening with abrasion.

11. A method of making a device attachable to an easy-open can end of the type comprising a closure defined by a weakening line, the method including:

1. providing a finger-bendable strip of flat sheet metal of general S-shape having a depressor portion with a beak formed on one end and a handle portion on the other end;
2. providing between said portions a formation for effecting pivotal connection to the can end to initially hold the device substantially parallel to the can end; and
3. forming a flange on a convex section of the depressor portion for accommodating finger pressure substantially normal to the can end.

12. The method of claim 11 and selecting the curvature of said convex section to provide interference with an edge of the closure upon its being opened by force exerted thereon by the beak whereby entry of the depressor portion into the can end opening is limited.

13. A can end comprising a closure at least partly defined by a scoring line extending through a rupturable locality adjacent to the perimeter of the can end, and an elongated, twistable strip of sheet metal non-detachably connected to the can end adjacent to a radially inner edge of an opening to be made therein upon force being exerted against said locality by a point end of the strip, after the strip has been lifted in a flanged mid-portion from the can end and pressure manually applied to said mid-portion to move the pointed end and thus deflect the closure inwardly of the can.

* * * * *

UNITED STATES PATENT OFFICE

CERTIFICATE OF CORRECTION

Patent No. 4,141,464 Dated February 27, 1979

Inventor(s) John S. Kelley - Albert E. Newton

It is certified that error appears in the above-identified patent and that said Letters Patent are hereby corrected as shown below:

Column 4, Cl. 8, Line 50, delete "of" and insert -----to -----

Column 6, Cl. 13, Line 10, change "point" to ------pointed ----

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*